US006016773A

United States Patent [19]

Zinke

[11] Patent Number: 6,016,773

[45] Date of Patent: Jan. 25, 2000

[54] PULSE COMBUSTION STEAM GENERATOR

[76] Inventor: Robert Dan Zinke, 7007 Metro Pkwy., Sterling Heights, Mich. 48311

[21] Appl. No.: 09/197,551

[22] Filed: Nov. 23, 1998

[51] Int. Cl.[7] ..... F22B 31/00

[52] U.S. Cl. ..... 122/24

[58] Field of Search ..... 122/24; 431/19, 431/31, 71

[56] References Cited

U.S. PATENT DOCUMENTS 4,241,720 12/1980 Kitchen ..... 126/110 C
4,960,078 10/1990 Yokoyama et al. ..... 122/24
5,168,835 12/1992 Last ..... 122/24
5,403,180 4/1995 Chato ..... 122/24

*Primary Examiner*—Teresa Walberg
*Assistant Examiner*—Gregory A. Wilson

[57] ABSTRACT

A hot water boiler and steam generator uses pulse combustion in order to efficiently heat water or other suitable working fluid. The exhaust system has a greater flow resistance adjacent the combustion chamber so that a self-sustaining and continuous pulse combustion can be maintained at thermal equilibrium with higher water temperatures and lower exhaust flue temperatures.

1 Claim, 1 Drawing Sheet

PULSE COMBUSTION STEAM GENERATOR

BACKGROUND OF THE INVENTION

Field of the Invention

This invention concerns heating water or other fluids using pulse combustion. See U.S. Pat. No. 5,793,119 issued on Aug. 11, 1998 which describes heating thermoelectric components using pulse combustion.

A major problem with steam boilers and hot water heaters is the poor efficiency of the process. This poor efficiency of converting fossil fuel energy into heat for water can be improved somewhat if externally augmented by auxiliary power such as electrically powered flue blowers. This is often done but the improvement in combustion efficiency is offset by the consumption of costly electrical power.

Water can be heated more efficiently with pulse combustion because part of the fossil fuel combustion energy is used to force the flue products through the chimney. Because this forcing action is present with pulse combustion, flue products may be cooled below the temperature needed to provide sufficient chimney draft and this allows designs which transfer more heat from the combustion exhaust products to the water. Present pulse combustion water heater designs, however, are limited in that they cannot heat the water to a higher temperature than the flue products and still be efficient at colder water temperatures. This is because the combustion process is not sustainable at higher water temperatures with present designs.

Currently existing pulse combustion hot air furnaces are capable of operating indefinitely because the heated air delivered to the building's warm air registers is always colder than the combustion products in the furnace exhaust flue.

SUMMARY OF THE INVENTION

The above object, which will be understood upon a reading of the following specification and claims, is achieved by the proper configuration of properly sized components to create a pulse combustion boiler.

Highly effective heat transfer conditions are created by the use of a pulse combustion process as a heat source, due to the fact that none of the heat energy has to be wasted for the purpose of venting flue products and the constant pulsation of the hot gases in the exhaust pipe enables better heat transfer from the gas to the surrounding walls (the condition of stagnant or laminar gas flow next to the walls is mitigated).

In a simplified embodiment with an exhaust pipe of constant interior diameter, a pulse combustion boiler has an curved exhaust pipe with different radii of curvature for each bend. The radius of curvature is a significant determinant of both heat transfer and resistance to compressible fluid flow occuring within each bend. Bend locations and radii of curvature are balanced so that intermittant fossil fuel detonations within the combustion chamber are self sustaining and continue regardless of fluctuations in boiler temperature. There must be enough resistance to exhaust flow so that the detonation within the combustion chamber completely burns the fuel, produces no carbon monoxide, and develops enough pressure to vent the exhaust through the pipes. The exhaust products in the pipes must be given enough momentum to create a vacuum inside the combustion chamber after the detonation, drawing in more fuel and air for the next detonation. This vacuum must also be sufficient to pull some of the hot exhaust products back into the combustion chamber to reignite the next charge, making the pulse combustion process self-sustaining while using no energy other than that in the fuel. Those exhaust products returning to the combustion chamber must be delayed sufficiently by resistance to flow as determined by exhaust pipe configuration.

DETAILED DESCRIPTION

Figure 1:
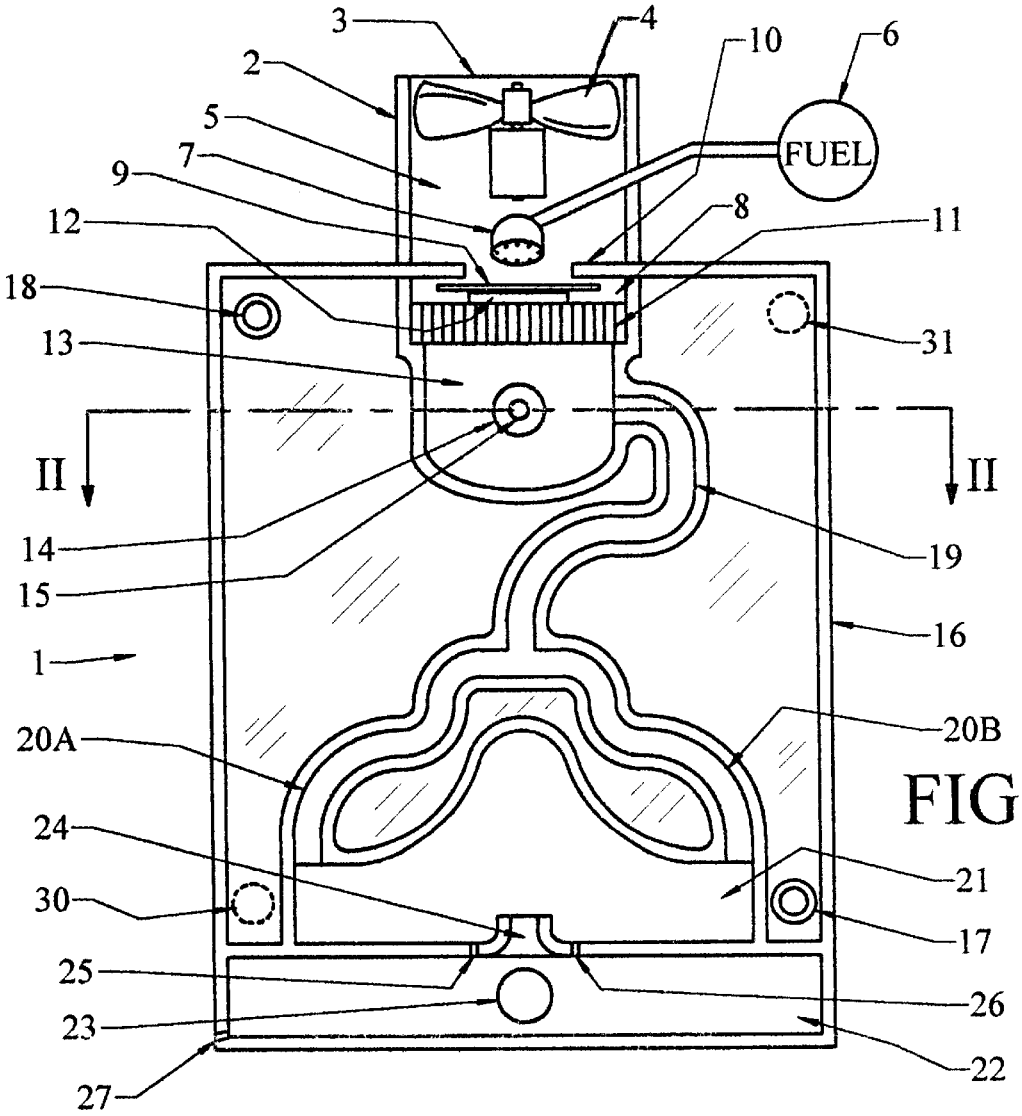
FIG. 1 is a diagramatic representation of a pulse combustion boiler according to the present invention.

In the following detailed description, certain specific terminology will be employed for the sake of clarity and a particular embodiment described in accordance with the requirements of 35 USC 112, but it is understood that the same is not intended to be limiting and should not be so construed inasmuch as the invention is capable of taking many forms and variations within the scope of the appended claims.

The present invention utilizes pulse combustion as a heat source. Pulse combustion has recently been applied to central heating plants for homes and businesses, hot water heaters, and similar devices.

In pulse combustion installations, a charge of a fuel-air mixture is initially forced into a combustion chamber and ignited. The mixture explodes, the gaseous products rapidly expanding into one or more exhaust pipes, thence into an exhaust "decoupler." The spent gases are thereafter exhausted from the system. In these applications, high efficiency heat generation is achieved since the rapidly repeated explosive combustion of the fuel-air mixture creates a dynamic expulsion of the combustion products which allows cooling of the gases to a much greater degree, enabling the extraction of a greater proportion of heat energy.

In conventional heating plants, the gases cannot be cooled to this degree since heat energy is used to exhaust the gases from the system, and the gases must be exhausted at higher temperatures, reducing the efficiency of the process.

If the flow resistance of the exhaust pipe is designed properly, a slight vacuum develops momentarily in the combustion chamber as a result of the momentum of the rapidly expanding gases, which vacuum causes drawing in of a fresh charge. The fresh charge is reignited by a reflected pressure wave or by the products of the previously combusted charge of the fuel-air mixture (partially drawn back into the combustion chamber by the vacuum) and a self-sustaining "pulse" combustion proceeds.

The exhaust pipe must present an ever decreasing flow resistance downstream so that as the rate of cooling of the gases changes due to a reduced rate of heat transfer and decreasing gas temperatures, the pulsing combustion will be able to continue. As long as this condition is present, a continuous generation of steam by the boiler is possible even after thermal equilibrium has been established within the boiler and allows it to be used as a source of power and more than merely a source of heat.

Accordingly, pulse combustion is highly efficient and requires only minimal componentry since the explosive combustion of the charge causes the forced exhaustion of the combustion gases to minimize the heat energy used to vent the exhaust gases.

With proper design, the exhaust gases can be cooled considerably by heat transfer into the surrounding structure while maintaining a self-sustained pulse combustion process. A careful balance in flow dynamics must be maintained so that the explosive outflow of exhaust gases continues to create a momentary vaccum in each pulse combustion interval to draw in a fresh charge on a self-sustaining basis. The exhaust decoupler is so-called since it must be large enough to present minimal flow resistance and substantially dissipate the pressure pulsations. If not sufficiently large, the pulsed combustion process can be adversely affected.

Referring to drawing FIG. 1, a pulse combustion boiler 1 according to the present invention is depicted in diagrammatic form. Pulse combustion boiler 1 includes a housing 2 defining an air inlet 3 into which an air flow is directed, initially induced by a blower 4.

The housing 2 also defines an air inlet chamber 5 into which fuel from a source 6 is sprayed through an atomizer head 7.

The housing 2 is adjacent to a flapper valve section 8 communicating with the air inlet chamber 5 whenever a flapper valve 9 is moved off a valve seat 10 defined by a partition plate. Once pulsing combustion has started, the fuel can flow at a constant rate or be intermittently interrupted by a separate fuel-only flapper valve (not shown). To prevent explosions in the housing during start-up, a purge cycle (fan only operation for a few seconds) may be desired prior to fuel introduction or spark initiation.

A flame arrester 11 is spaced across from the flapper valve seat 10 and has a stop plate 12 affixed thereto and aligned to be engaged by the flapper valve 9, as will be described. The flame arrester 11 comprises a well known open metallic mesh structure which allows passage of the fuel-air mixture into the combustion chamber 13, but prevents a flame front from propagating in a reverse direction.

The combustion chamber 13 is a central opening in the boiler 1 structure and includes an opening 14 for the spark plug 15. The boiler 1 is constucted of two hollow structures, one inside the other. The outer structure is the holding tank 16 which is made out of a leak-proof material capable of withstanding operating pressures. Cold water, or a suitable working fluid, enters holding tank 16 at lower orifice 17. Once heated, the water, steam, or other working fluid exits through upper orifice 18. The inner structure is defined by the combustion chamber 13, exhaust pipes 19, 20A, 20B and exhaust decoupler 21. Combustion of the fuel-air mixture takes place entirely within the inner structure, which is made of a leak-proof material capable of withstanding operating pressures and conducting heat from within the inner structure to the water or working fluid.

A spark plug, glow plug, or other igniter 15 is mounted projecting into the combustion chamber 13 through the opening 14 provided in the inner structure. Opening 14 extends through the holding tank 16 so that the spark plug 15 can be inserted from outside boiler 1, a spark plug cable (not shown) can be installed, and spark plug 15 is not wetted by the water or other suitable working fluid contained within holding tank 16. Once ignited by spark plug 15, products of combustion successively flow through the inner structure comprised of the combustion chamber 13, exhaust pipes 19, 20A, 20B and exhaust decoupler 21. The exhaust pipes 19, 20A, 20B must have the proper flow resistance as described above. From exhaust decoupler 21, exhaust gases are vented to a muffler 22 (if necessary because of noise) and from the muffler 22 to an exhaust flue or chimney (not shown) that is connected to muffler exhaust vent 23.

To initiate operation, the blower 4 is energized, directing an air flow into the air inlet chamber 5 (which acts as an inlet decoupler/muffler), with a fuel charge sprayed into the air through atomizer head 7. The flapper valve 9 is initially positioned over the stop plate 12, allowing flow of a charge of the air-fuel mixture into the combustion chamber 13, where it is ignited with the spark plug 15.

The pressure generated by the resulting explosive combustion of the air-fuel mixture causes the flapper valve 9 to move onto the valve seat 10, causing the combustion chamber 13 to be isolated from the air inlet chamber 5 and thus preventing the flow of additional fuel-air mixture into the combustion chamber 13.

A large proportion of the heat developed by the combustion in chamber 13 is tranferred into the wall of the inner structure since exhaust air flow is caused by mechanical action, i.e., by the effect of detonations in the combustion chamber 13 and excess heat is not necessary to vent exhaust gases.

The products of combustion explosively expand into the exhaust system 19, 20A, 20B, 21 in such a manner that a vacuum momentarily develops in the combustion chamber 13, causing flapper valve 9 to again unseat and inducing flow of another charge of air-fuel mixture into the combustion chamber 13.

After start up, the pulse combustion cycles repeat continuously without the need for the blower 4 or igniter 15.

Combustion chamber 13 is of sufficient volume to contain enough fuel-air mixture so that adequate energy is available to push exhaust gases downstream. From combustion chamber 13, products of combustion initially enter exhaust pipe 19. The bends of exhaust pipe 19 have smaller radii near the combustion chamber 13. The smaller radii bends have the greatest resistance to exhaust gas flow and the highest rate of heat transfer per surface area. Because the exhaust products are cooled and become more dense as they move downstream, exhaust pipe 19 splits into two exhaust pipes 20A and 20B to reduce flow resistance and provide more heat transfer surface area. As does exhaust pipe 19 above, exhaust pipe 20A and 20B bends have smaller radii near the entrance than near the exit. This ensures that flow resistance continues to decrease slightly as exhaust products flow downstream towards the exit, which is at exhaust decoupler 21. Exhaust decoupler 21 is of sufficient volume to contain the exhaust products and permit upstream combustion to be complete enough so that carbon monoxide production does not exceed legal restrictions. Exhaust gases flow from exhaust decoupler 21 through orifice 24 and into muffler 22. Exhaust vent 23 leads to chimney tube (not shown). The configuration of the exhaust system 19, 20A, 20B, 21 is such that exhaust product condensate is able to drain downwards. Condensate holes 25, 26, and 27 permit liquid formed from exhaust product condensate to drain from boiler 1.

The boiler described aboved could be fabricated by various means. One embodiment could have a cast iron combustion chamber connected to an exhaust pipe fabricated out of copper tubing components that have been soldered together. Such an assembly could be installed inside a water tank which could be a large metal tank or drum.

Figure 2:
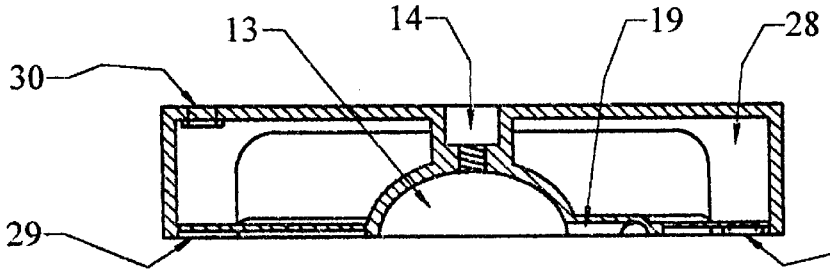
FIG. 2 is a diagramatic representation of the interior of the pulse combustion boiler section shown in FIG. 1.

Another embodiment would have both the exhaust system and the water tank combined together into one piece as a metal casting. For such an embodiment, FIG. 2 would be applicable for depicting the interior configuration of the object shown in FIG. 1. FIG. 2 shows a single, hollow casting with the interior water chamber 28 being formed by means of inserting an appropriately configured core into the mold. Spark plug 15 (not shown) would be installed into opening 14 and would extend partially into combustion chamber 13. Two such castings would be required for each boiler with the second casting being a mirror image of the first so that the two exhaust pipe 19 halves coincide to form the complete exhaust pipe 19 when the two castings are bolted together at the mating surfaces 29 to form a single complete boiler. Only one blower 4, fuel nozzle 7, flapper valve 9, flame trap 11, and spark plug 15 would be required for each such boiler. For an alternate design, if exhaust pipe 19 were centered at the bottom of combustion chamber 13 or if two exhaust pipes 19 exited the combustion chamber 13 with one on each side and left-right symmetry was present throughout the casting, only one casting design would be necessary. Two identical castings (although machined differently) could then be bolted together at mating surfaces 29 to form the one boiler. Water or other suitable working fluid contained in holding chamber 28 of both castings would be in communication with each other through lower orifice 17 and upper orifice 18. Water or other suitable working fluid would enter the boiler through lower inlet 30 and leave through upper outlet 31.

It should be understood that this device is not limited to only one flapper valve, one combustion chamber, one or two exhaust pipes, or that the exhaust pipe must be of circular cross section. It is important that the components be sized properly in relation to each other so that the pulse combustion process can take place and do so without unacceptably high carbon monoxide emissions. It is important that the pulse combustion process is able to continue even after the boiler has achieved thermodynamic equilibrium. This allows the pulse combustion device to produce a steady amount of heat indefinitely. This enables the construction of pulse combustion hot water heaters of smaller mass. It allows steam generators to continuously produce a constant head of pressure.

Efficient pulse combustion boiler designs may have more than one exhaust passageway. Such passageways may be curved and have bends or surface discontinuities for improved heat transfer and to achieve desired flow resistance characteristics. To make pulse combustion possible with low exhaust gas temperature once thermal operating equilibrium has been established, it is important that exhaust passageways near the combustion chamber have greater resistance to hot gas flow than those passageways farther downstream, as mentioned above. This resistance is measured by determining the Nusselt number (Nu) which is a combination of the Prandtl number (Pr) and the Reynolds number (Re). The Colburn correlation:

$$Nu=0.023\ Re^{0.8}Pr^{1/3}$$

works well for the application shown in FIG. 1.

I claim:

1. A method of heating water or other suitable working fluid by means of carrying out a pulse combustion process in a combustion chamber with an exhaust system in which there is established a greater resistance to outflow of said gases in said exhaust system at points clqser to said combustion chamber than at points farther downstream from said combustion chamber; wherein said step of establishing flow resistance includes the step of determining said decreasing flow resistance in correspondence with the Nusselt number of said flow of gases in said exhaust system; surrounding said combustion chamber and at least part of said exhaust system with water or a suitable working fluid; and distributing said water, steam, or suitable working fluid away from boiler to a device able to utilize the heated water, steam, or working fluid.

* * * * *